United States Patent [19]

Roberts

[11] 4,012,179

[45] Mar. 15, 1977

[54] SEALING GRID FOR A ROTARY PISTON MECHANISM

[75] Inventor: Thomas C. Roberts, Ridgewood, N.J.

[73] Assignee: Curtiss-Wright Corporation, Wood-Ridge, N.J.

[22] Filed: Mar. 27, 1975

[21] Appl. No.: 562,806

[52] U.S. Cl. ..... 418/120; 418/142

[51] Int. Cl.[2] ..... F01C 19/04; F01C 19/08

[58] Field of Search ..... 418/113, 120, 121, 142; 123/8.01, 8.45; 277/81 P

[56] References Cited

UNITED STATES PATENTS

| | | | |
|---|---|---|---|
| 1,237,768 | 8/1917 | Ferguson et al. | 418/142 |
| 3,064,880 | 11/1962 | Wankel et al. | 418/142 |
| 3,180,562 | 4/1965 | Bentele | 418/142 |
| 3,674,384 | 7/1972 | Larrinaga et al. | 418/142 |

FOREIGN PATENTS OR APPLICATIONS

| | | | |
|---|---|---|---|
| 1,166,548 | 3/1964 | Germany | 418/142 |
| 1,175,941 | 8/1964 | Germany | 418/142 |

*Primary Examiner*—John J. Vrablik
*Attorney, Agent, or Firm*—Arthur Frederick; Victor D. Behn

[57] ABSTRACT

The sealing grid is for a rotary piston mechanism having a multi-profile rotor forming apex portions, which rotor is supported for planetary rotary movement in a housing cavity. The sealing grid comprises an apex seal assembly carried in each of the apex portions of the rotor, which assembly includes an apex seal blade. Also forming part of the sealing grid are apex seal pins disposed in the opposite side faces of the rotor and at each of the apex portions. The grid additionally includes side gas seal strips carried in each of the opposite side faces of the rotor. One end portion of each side gas seal strip is disposed in abutment against an apex seal blade at one apex portion while the opposite end portion engages the apex seal pin located at an adjacent apex portion. The grid further includes a biasing means for each side gas seal strip for urging the associated side gas seal strip in an endwise direction and into abutment against the apex seal blade associated therewith.

5 Claims, 4 Drawing Figures

SEALING GRID FOR A ROTARY PISTON MECHANISM

This invention relates to the sealing grid for a rotary piston mechanism of the Wankel type as disclosed in the U.S. Pat. No. 2,988,065, to Wankel et al, and which mechanism may be either a rotary piston internal combustion engine, expansion engine, blower, compressor or pump.

Heretofore, one type of sealing grid for rotary mechanisms of the Wankel type, as exemplified in the U.S. Pat. No. 3,142,439 to Froede dated July 28, 1964 and Anderson U.S. Pat. No. 3,102,518 dated Sept. 3, 1963 employs, in each side face and at each apex portion of the piston or rotor, an apex seal pin which has one or more "chordal" steps or shoulders in the outer end thereof. Each of the shoulders must be matched or mated to the associated side gas seal groove so that the side gas seal strip in that groove engages both the groove surface and the shoulder to thereby provide optimum effective sealing. It has been found that, if a side gas seal groove is misaligned relative to its associated apex seal pin shoulder as little as one thousandths of an inch (0.001 inch), the leakage for that area of the seal grid might increase as much as twelve percent (12%). Therefore, to insure this proper mating of the apex pin shoulder and its associated side gas seal groove both are preferably simultaneously machined. Accordingly, each apex seal pin must be marked and identified relative to its associated groove or grooves and then be retained with the rotor to insure that, in assembly of the mechanism, the proper apex seal pin is positioned in the proper rotor location. Obviously this lack of interchangeability of apex seal pins not only increases cost of fabrication and assembly but also poses difficulties in effecting proper repairs involving replacement of one or more apex seal pins.

One proposed solution to this problem is as disclosed in the U.S. Pat. No. 3,674,384 to Larrinaga et al dated July 4, 1972 wherein the apex seal pin is machined to provide a reduced diameter outer end portion. The reduced end portion is of a diameter such that the associated side gas seal groove lies substantially tangentially of the peripheral surface of the reduced end portion. Here again matching of the apex pin is desirable although such matching is of less critical nature than in the other seal grids previously discussed herein. The present invention therefore further seeks to eliminate the heretofore apex seal pin interchangeability problem.

Accordingly, it is one object of this invention to provide a sealing grid for a rotary piston mechanism which obviates the necessity for matching an apex seal pin to its associated side gas seal strip and the groove in which they are carried.

It is another object of this invention to provide a sealing grid for a rotary piston mechanism having interchangeable apex seal pins.

It is a further object of the present invention to provide a sealing grid for a rotary piston mechanism which is relatively easy to install in the assembly of the mechanism.

It is a still further object of this invention to provide a sealing grid for a rotary piston mechanism which provides optimum sealing without the necessity of matching an apex seal pin to a particular location in the rotor.

SUMMARY

Accordingly, the present invention contemplates an improved sealing grid for a rotary piston mechanism of the Wankel type which has end walls spaced apart by a peripheral wall to define therebetween a housing cavity within which a rotor is supported for planetary rotation on the eccentric portion of a mainshaft. The rotor has opposite side faces and peripheral surfaces or flank portions which intersect each other to form apex portions. The rotor defines with the housing cavity a plurality of working chambers which successively expand and contract in volumetric size as the rotor rotates within the housing cavity. The improved sealing grid functions to substantially isolate the working chambers from each other and prevent leakage of gaseous fluid from the working chambers.

The improved sealing grid comprises an apex seal assembly for each of the rotor apex portions. Each of the apex seal assemblies has a seal blade means supported in a radially extending apex groove in each of the rotor apex portions. An apex recess which is generally circular is provided in each side face of the rotor and at each of the apex portions. The recess is disposed and dimensioned so as to communicate with said apex groove. An apex seal pin having a substantially radially extending notch is slidably receivable in each of the apex recesses with the notch of the apex seal pin in register with the apex groove associated with the apex recess. A plurality of gas seal grooves are provided in each side face of the rotor so as to extend from one apex portion to another apex portion of the rotor. Each of the gas seal grooves is in communication, at one end, with an apex groove and out of communication with an apex recess associated with that apex groove and, at the opposite end, in communication with the apex recess in the next adjacent apex portion of the rotor. A gas seal strip is disposed in each of the gas seal grooves and is dimensioned to abut at one end a seal blade means in one apex portion. A biasing means is carried in each of the apex seal pins and is disposed to engage one end of the associated gas seal strip to urge the latter endwise and the opposite end of the gas seal strip in abutment against the seal blade means of the adjacent apex portion.

In a narrower aspect of the present invention each of the apex seal pins is provided with a cavity which communicates with one end of a gas seal groove to receive one end of a gas seal strip. The cavity also receives a biasing means for resiliently exerting an endwise force on the associated gas seal strip.

BRIEF DESCRIPTION OF THE DRAWINGS

The invention will be more fully understood from the following description when considered in connection with the accompanying drawings in which.

DESCRIPTION OF THE PREFERRED EMBODIMENT

Figure 1:
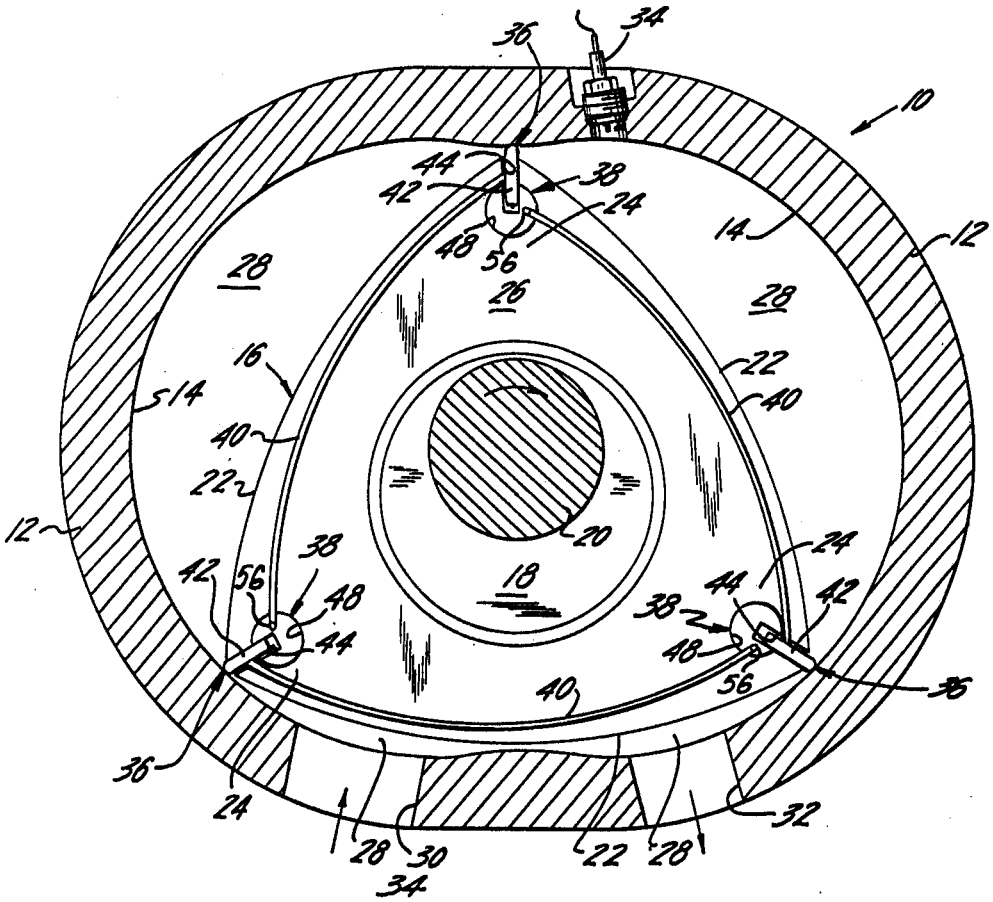
FIG. 1 is a transverse cross-sectional view through a rotary piston mechanism having the improved seal grid according to this invention.

Now referring to the drawings and more specifically FIG. 1, the reference number 10 generally refers to a rotary piston mechanism of the Wankel type having a sealing grid according to this invention. The mechanism 10 is shown in FIG. 1 as an internal combustion engine, but it is to be understood that the invention also has application to compressors, expanders, blowers and pumps.

As shown, mechanism 10 comprises a housing 12 which is so formed as to define a two-lobe cavity having an inner peripheral surface 14 of trochoidal shape and opposite end wall surfaces 15 (only one of which is shown in FIG. 1). A rotor 16 is supported for planetary motion within the cavity on an eccentric portion 18 of a mainshaft 20. The rotor 16 has three peripheral surfaces or flank portions 22 which converge to form apex portions 24 and has opposite side faces 26 (only one of which is shown in the drawings) adjacent housing end wall surfaces 15. The rotor defines with the housing 12 a plurality of working chambers 28 which successively expand and contract in volumetric size as the rotor planetates within the housing cavity. To introduce a fuel and air mixture into successive working chambers, an intake port 30 is provided in housing 12. An exhaust port 32 is provided in housing 12 to pass spent combustion products from successive working chambers 28. For ignition of the compressed fuel and air mixture in working chambers 28, a spark plug 34 is secured in housing 12. The mechanism 10 is provided with a sealing grid according to this invention to substantially isolate working chambers 28 from each other.

The sealing grid of this invention comprises an apex seal assembly 36 located at each of the apex portions 24 of rotor 16, an apex seal pin 38 disposed in each side face 26 of rotor 16 at each apex portion 24, and a plurality of gas seal strips 40 carried in each side face 26 of the rotor and extending from one apex portion 24 to the next adjacent apex portion 24.

Each of the apex seal assemblies 36 may be of any suitable type such as disclosed in the U.S. Pat. No. 3,400,691 to Jones, dated Sept. 10, 1968, Bentele U.S. Pat. No. 3,180,562, dated Apr. 27, 1965 and Jones, U.S. Pat. No. 3,300,124 dated Jan. 24, 1967 having a single or multi-piece blade means 42 disposed within a radially extending groove 44 in the apex portion 24 of rotor 16. A biasing means, such as a spring (not shown) may be provided to urge the blade means 42 in a direction outwardly of groove 44 and into engagement with peripheral surface 14.

Each apex seal pin 38 has a cylindrical body 46 which is receivable in a cylindrical recess 48 extending inwardly from side faces 26 of rotor 16. A radially extending notch 50 is provided in each of the apex pins 38. The notch 50 is dimensioned to be of substantially the same width as groove 44 and is arranged to be coextensive with the latter so as to receive the lower end portion of blade means 42. A washer like spring (not shown) may be provided in recess 48 and behind apex pin 38 to urge the apex pin in a direction outwardly of its associated recess. Such a spring is disclosed in the U.S. Pat. No. 3,180,562 to Bentele dated Apr. 27, 1965. The apex pins 38 engage the adjacent housing side wall surfaces 15 and function to seal the space between blade means 42 and side gas seal strips 40.

Figure 2:
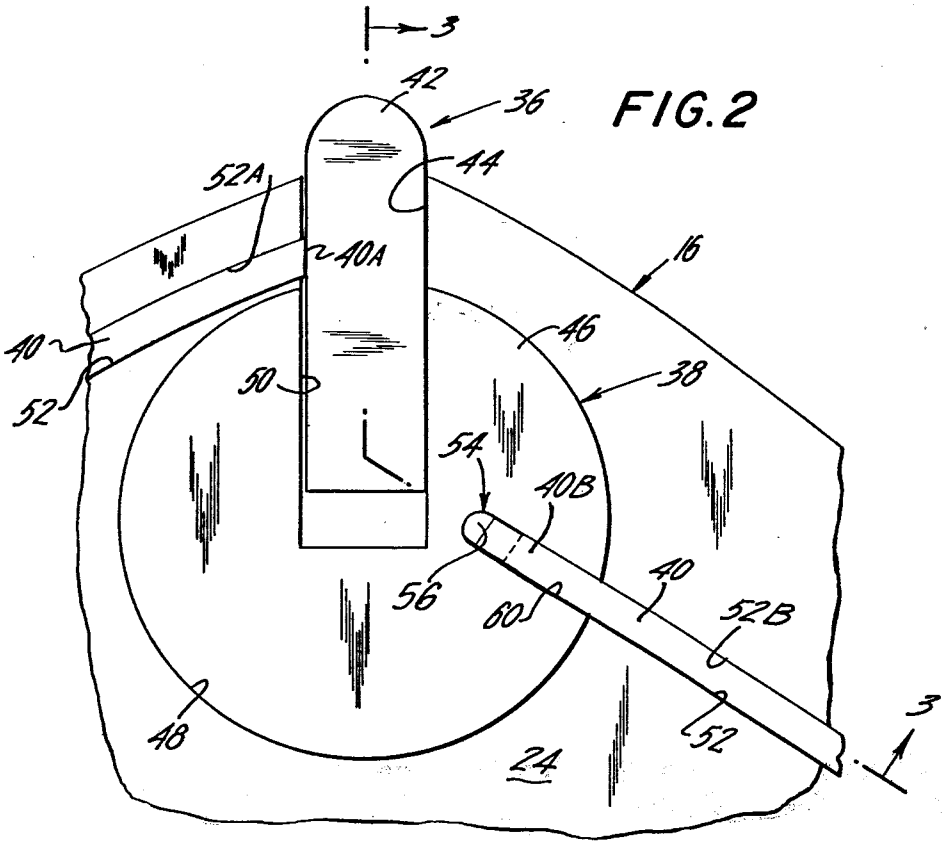
FIG. 2 is an enlarged fragmentary view of one of the apex portions of the rotor of the rotary piston mechanism shown in FIG. 1.

In accordance with the present invention and as best illustrated in FIG. 2 the elongated grooves 52 into which each of the gas seal strips 40 are located such that one end portion 52A of each groove 52 is out of communication with an apex pin recess 48 and the opposite end portion 52B of such groove 52 is in communication with the apex pin recess 48 of the next adjacent apex portion 24. Each gas seal strip 40 may be biased in a direction outwardly of its associated groove 52 by a spring means 53 (shown in FIG. 3) such as the wavy spring disclosed in U.S. Pat. No. 3,033,180 to Bentele dated May 8, 1962 so as to thereby maintain the associated gas seal strip in engagement with the adjacent side wall surface 15. Since the end portion of each gas seal strip 40 adjacent end portion 52A of its associated groove 52 is not in contact with apex pin 38, sealing of the leakage flow path adjacent the left side of seal blade means 42 as viewed in FIG. 2, is achieved by engagement of the end 40A of gas seal strip 40 against seal blade means 42. To urge each gas seal strip 40 into impingement against its associated seal blade means 42, a biasing means 54 is carried in the next adjacent apex pin 38 to engage the opposite end 40B of the gas seal strip 40.

Figure 3:
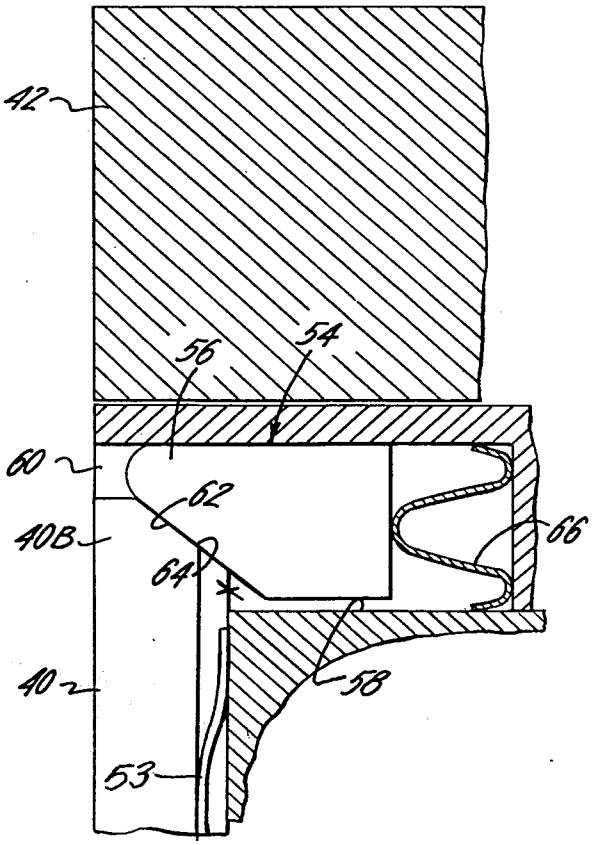
FIG. 3 is a cross-sectional view taken substantially along line 3—3 of FIG. 2.

As best shown in FIG. 3, each biasing means 54 comprises a wedge element 56 which is slidably receivable in a recess or cavity 58. This cavity extends inwardly from the outer surface of the associated apex pin 38 and substantially parallel to the longitudinal axis of that apex pin 38. The outer end of cavity 58 communicates with the bottom of a groove 60 provided in the outer end surface face of the apex seal pin. The groove 60 in each apex pin is so located relative to notch 50 of the apex pin that groove 60 is coextensive with groove 52 and is adapted to receive end portion 40B of gas seal strip 40. The wedge element 56 has an inclined camming surface 62 which engages a complementary inclined surface 64 at the end of the associated gas seal strip 40. A spring 66 is disposed between the bottom of cavity 58 and wedge element 56 to exert a force on the latter outwardly of cavity 58 (to the left as viewed in FIG. 3). This biasing force at the abutting inclined surfaces 62 and 64 produces a reaction force component directed longitudinally of the associated gas seal strip 40 which urges its opposite end 40A into abutment against seal blade means 42.

Figure 4:
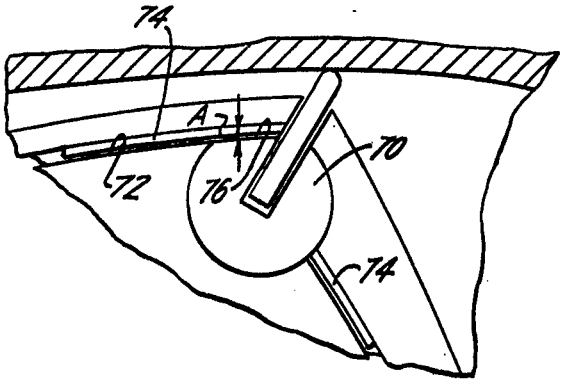
FIG. 4 PRIOR ART
FIG. 4 is a view, similar to FIG. 2, showing an apex portion of a rotor having a prior art sealing grid.

The herein described sealing grid, according to this invention, eliminates the requirement in the prior art sealing grid shown in FIG. 4 for matching an apex seal pin 70 to the associated gas seal strip groove 72 so as to insure proper engagement of gas seal strip 74 with the sealing shoulder 76 formed on apex seal pin 70. The necessity for this accurate mating of the apex seal pin 70 to the associated gas seal strip groove 72 is illustrated by the hereinafter set forth example.

If it assumed that the chordal notch in apex seal pin 70 forming sealing shoulder 76 is made 0.001 inch too wide as indicated at A in FIG. 4, the leakage area would be computed as follows:

0.001 inch (oversize of width) × 0.100 inch (seal height) = 0.0001 square inch

Thus, when this leakage flow area of 0.0001 square inches is compared with the minimal acceptable leakage flow area of 0.0008 square inch, it is found that a manufacturing error of 0.001 inch can produce a twelve percent (12%) increase in the leakage flow area.

In the sealing grid of this invention groove 60 in each of the apex seal pins 38 need not be accurately formed in relation to the end portion 52B of the associated seal strip groove 52 since the end portion 40B of gas seal strip 40 receivable in groove 60 need not sealingly engage the walls of groove 60, sealing being effected by reason of the abutment of seal blade means 42 against the wall of notch 50 adjacent groove 60.

It is believed now readily apparent that the present invention provides a sealing grid which does not require the matching of apex seal pins with its associated side gas strip grooves and therefore provides a sealing grid in which apex seal pins are interchangeable with each other with respect to apex location in the rotor without detrimental effect on sealing effectiveness. It is a sealing grid in which positive sealing abutment is maintained between each of the side seal strips and a seal blade means.

Although but one embodiment of the invention has been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. In a rotary piston mechanism having end walls spaced apart by a peripheral wall to define therebetween a housing cavity within which a rotor is supported for planetary rotation, the rotor having opposite side faces and peripheral surfaces intersecting each other to form apex portions and defining with the housing cavity a plurality of working chambers which successively expand and contract in volumetric size as the rotor planetates within said housing cavity, an improved sealing grid for substantially isolating the working chambers from each other, the sealing grid comprising:

a. an apex seal assembly for each of the rotor apex portions;

b. each of said apex seal assemblies has a blade means supported in a radially extending apex groove in each of the apex portions of the rotor;

c. an apex seal pin for each apex portion carried in each side face and at each apex portion of the rotor;

d. a plurality of gas seal strips carried in each side face of the rotor;

e. each gas seal strip extending at one end in engagement with a blade means associated with one apex portion and out of contact with the apex seal pin associated with this blade means and to engagement with the apex seal pin associated with the next adjacent apex seal pin;

f. a first spring for each gas seal strip disposed in said rotor side faces to urge the associated gas seal strip toward and against the adjacent end wall; and g. a biasing means for each gas seal strip, including a wedge element and a second spring, separate from each of the first springs, carried in each of the apex seal pins so as to engage one end of the associated gas seal strip and urge the latter endwise to thereby maintain the other end of the associated gas seal strip in engagement with the blade means associated with the next adjacent apex portion.

2. The apparatus of claim 1 wherein each of said apex seal pins has a cavity therein and a communicating groove dimensioned and positioned to receive one end portion of a gas seal strip and wherein said wedge element is slidably disposed in the cavity to abut at one end the said one end portion of said gas seal strip to resiliently urge the latter in said endwise direction.

3. In a rotary piston mechanism having end walls spaced apart by a peripheral wall to define therebetween a housing cavity within which a rotor is supported for planetary rotation, the rotor having opposite side faces and peripheral surfaces intersecting each other to form apex portions and defining with the housing cavity a plurality of working chambers which successively expand and contract in volumetric size as the rotor planetates within said housing cavity, an improved sealing grid for substantially isolating the working chambers from each other, the sealing grid comprising:

a. an apex seal assembly for each of the rotor apex portions;

b. each of said apex seal assemblies has a seal blade means supported in a radially extending apex groove in each of the apex portions of the rotor;

c. an apex recess in each side face of the rotor at each of the apex portions and disposed so as to communicate with said apex groove;

d. an apex seal pin for each apex recess and having a notch therein disposed in each apex recess with its notch in register with the apex groove so as to receive said blade means therein;

e. a plurality of gas seal grooves in each side face of the rotor and extending from one apex portion to the next adjacent apex portion of the rotor;

f. each of said gas seal grooves having one end in communication with an apex groove and out of communication with an apex recess associated with that apex groove and having the opposite end in communication with the apex recess in the next adjacent apex portion;

g. a cavity in each of said apex seal pins arranged to communicate with said opposite end of a gas seal groove;

h. a gas seal strip disposed in each gas seal groove and dimensioned so as to abut at one end of one of said seal blade means in one apex portion and, at the other end portion project into said cavity of the apex seal pin associated with the next adjacent apex portion;

i. a first spring for each gas seal strip disposed in said gas seal groove to urge the associated gas seal strip toward and against the adjacent end wall; and j. a biasing means for each gas seal strip, including a wedge element and a second spring, separate from each of the first springs, carried in each of said cavities of said apex seal pins so as to engage one end of the associated gas seal strip and urge the latter endwise to thereby maintain the other end of the associated gas seal strip in engagement with the blade means associated with the next adjacent apex portion.

4. The apparatus of claim 3 wherein each of said cavities comprises a depression extending inwardly from the peripheral surface of the apex seal pin coextensively with associated gas seal groove and a branch recess extending from the inner end portion of said depression substantially parallel to the longitudinal axis of the associated apex seal pin.

5. The apparatus of claim 4 wherein said biasing means comprises said wedge element disposed for slidable movement within said branch recess, said wedge element having an inclined end face portion which engages the end of an associated gas seal strip and a spring disposed in the branch recess and abutting the end of the wedge element at its end opposite said end face portion.

* * * * *